US009512695B2

(12) United States Patent
Pabon et al.

(10) Patent No.: US 9,512,695 B2
(45) Date of Patent: Dec. 6, 2016

(54) MULTI-STAGE WELL SYSTEM AND TECHNIQUE

(71) Applicant: Schlumberger Technology Corporation, Sugar Land, TX (US)

(72) Inventors: Jahir Pabon, Newton, MA (US); Matthew Godfrey, Watertown, MA (US); John David Rowatt, Harvard, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 753 days.

(21) Appl. No.: 13/931,104

(22) Filed: Jun. 28, 2013

(65) Prior Publication Data

US 2015/0000935 A1 Jan. 1, 2015

(51) Int. Cl.
*E21B 34/14* (2006.01)
*E21B 33/10* (2006.01)

(52) U.S. Cl.
CPC ..... *E21B 34/14* (2013.01); *E21B 33/10* (2013.01)

(58) Field of Classification Search
CPC ..... E21B 34/14; E21B 33/10; E21B 23/02; E21B 23/08; E21B 23/10
USPC ..... 166/193, 195
See application file for complete search history.

(56) References Cited

U.S. PATENT DOCUMENTS 2,352,612 A * 7/1944 Boynton ..... E21B 34/08 166/125
7,673,688 B1 3/2010 Jones et al.
2011/0056692 A1 3/2011 Lopez De Cardenas et al.
2011/0240311 A1 10/2011 Robison et al.
2011/0284240 A1* 11/2011 Chen ..... E21B 23/00 166/373
2012/0085538 A1 4/2012 Guerrero et al.

OTHER PUBLICATIONS

International Search Report and Written Opinion for PCT/US2014/042455 filed Oct. 27, 2014.
Baker Hughes, "Frac Point EX-C Frac Sleeve System", Retrieved from www.bakerhughes.com, 2011, 1 page.
Baker Hughes, "OptiPort Multistage Fracturing System", Retrieved from www.bakerhughes.com, 2011, 2 pages.
Halliburton, "Horizontal Completions Solutions", 2011, 3 pages.
NCS Energy Services, "Mongoose Jet-Perforating Frac System", Retrieved from http://ncsfrac.com/mongoosefrac.html, Accessed Aug. 15, 2014, 1 page.
Packers Plus, "StackFRAC HD—Multi-Statge Completion System", Retrieved from www.packersplus.com, Jul. 11, 2014, 2 pages.
Schlumberger, "Falcon Uncemented multistage stimulation system", Retrieved from internet: http://www.slb.com/~/media/Files/completions/product_sheets/mss/falcon_system_ps.pdf, 2012, 2 pages.
Schlumberger, "TAP Completion System: Multizone completions in a single, continuous operation", Dec. 2007, 4 pages.
Trican, "I-FRAC CEM", Data Sheet—Trican Completion Solutions, 2013, 2 pages.

* cited by examiner

*Primary Examiner* — Robert E Fuller
*Assistant Examiner* — David Carroll
(74) *Attorney, Agent, or Firm* — Jeffery R. Peterson

(57) ABSTRACT

A technique that is usable with a well includes communicating an untethered object in a passageway downhole in the well and using a cross-sectional dimension of the object and an axial dimension of the object to select a seat assembly of a plurality of seat assemblies to catch the object to form an obstruction in the well.

12 Claims, 10 Drawing Sheets

MULTI-STAGE WELL SYSTEM AND TECHNIQUE

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools. A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a system that is usable with a well includes a string and a plurality of assemblies that are disposed on the string such that a passageway of the string extends through the assemblies. The assemblies include a first assembly and a second assembly. The system further includes an untethered object that is adapted to be communicated through the passageway and be sufficiently radially compressed in response to engaging the first assembly to cause the object to pass through the first assembly. The object has a dimension to cause the object to be engaged by the second assembly to sufficiently restrict radial compression of the object to cause the object to be retained by the second assembly.

In another example implementation, an apparatus that is usable with a well includes a pivot connection and a plurality of members. The members are associated with orthogonal dimensions and are joined at least at the pivot connection to form first section and a second section. The members are adapted to be communicated without the use of a conveyance mechanism into the well; in response to engaging a seat assembly in the well, pivot about the pivot connection to radially expand the first section and radially compress the second section; and allow the orthogonal dimensions to be used to select whether the seat assembly catches the plurality of members.

In yet another example implementation, a technique that is usable with a well includes communicating an untethered object in a passageway downhole in the well and using a cross-sectional dimension of the object and an axial dimension of the object to select a seat assembly of a plurality of seat assemblies to catch the object to form an obstruction in the well.

Advantages and other features will become apparent from the following drawing, description and claims.

DETAILED DESCRIPTION

In general, systems and techniques are disclosed herein, for deploying untethered objects into a well and using the objects to perform various downhole operations. In this context, an "untethered object" refers to an object (a dart, a ball or a bar, as examples) that may be communicated downhole (along at least part of its path) without using a conveyance mechanism (a slickline, a wireline, or a coiled tubing string, as examples). The "downhole operation" refers a variety of operations that may be performed in the well due to the untethered object being "caught" by a particular tool of the tubing string or, in general, attaching to the string at a targeted downhole location.

For example, the untethered object may be constructed to target a particular sleeve valve of the tubing string, so that when the object is received in a seat of the valve, a fluid column above the valve in the string may be pressurized to shift the valve open or closed, depending on the implementation. As another example, the untethered object may be constructed to target a particular seat in the string to form an obstruction in the string to divert fluid, form a downhole barrier, form a seal for a plug, and so forth. As another example, the untethered object may target a particular single shot tool for purposes of actuating the tool. Thus, many applications for the untethered objects that are disclosed herein are contemplated and are within the scope of the appended claims.

As further discussed herein, multiple characteristic dimensions of the untethered object are used to discriminate among target downhole locations (valve seats, tools, and so forth) that are candidates for "catching" the object. This feature permits multiple degrees of freedom in selecting the downhole targets and is particularly advantageous over the use of a single object dimension (a cross-sectional dimension or diameter of the object, for example) to discriminate among potential candidates for catching the object, as can be appreciated by the skilled artisan.

More specifically, in accordance with example implementations that are disclosed herein, the untethered object is a dart, which has an associated axial dimension, or length, and an associated cross-sectional dimension, or diameter; and these two characteristic dimensions of the dart are used to target a given downhole seat assembly from a pool of potentially multiple downhole seat assemblies. As described further herein, although multiple seat assemblies of the well may have potential "dart catching" seats with the same inner diameter, the combination of the dart's axial length and the dart's diameter allow the selection of the seat assembly to catch the dart. Thus, for example, for a set of downhole seat assemblies that share the same inner seat diameter, darts that share the same dart diameter but have different axial lengths may be used to target different seat assemblies of this set.

Figure 1:
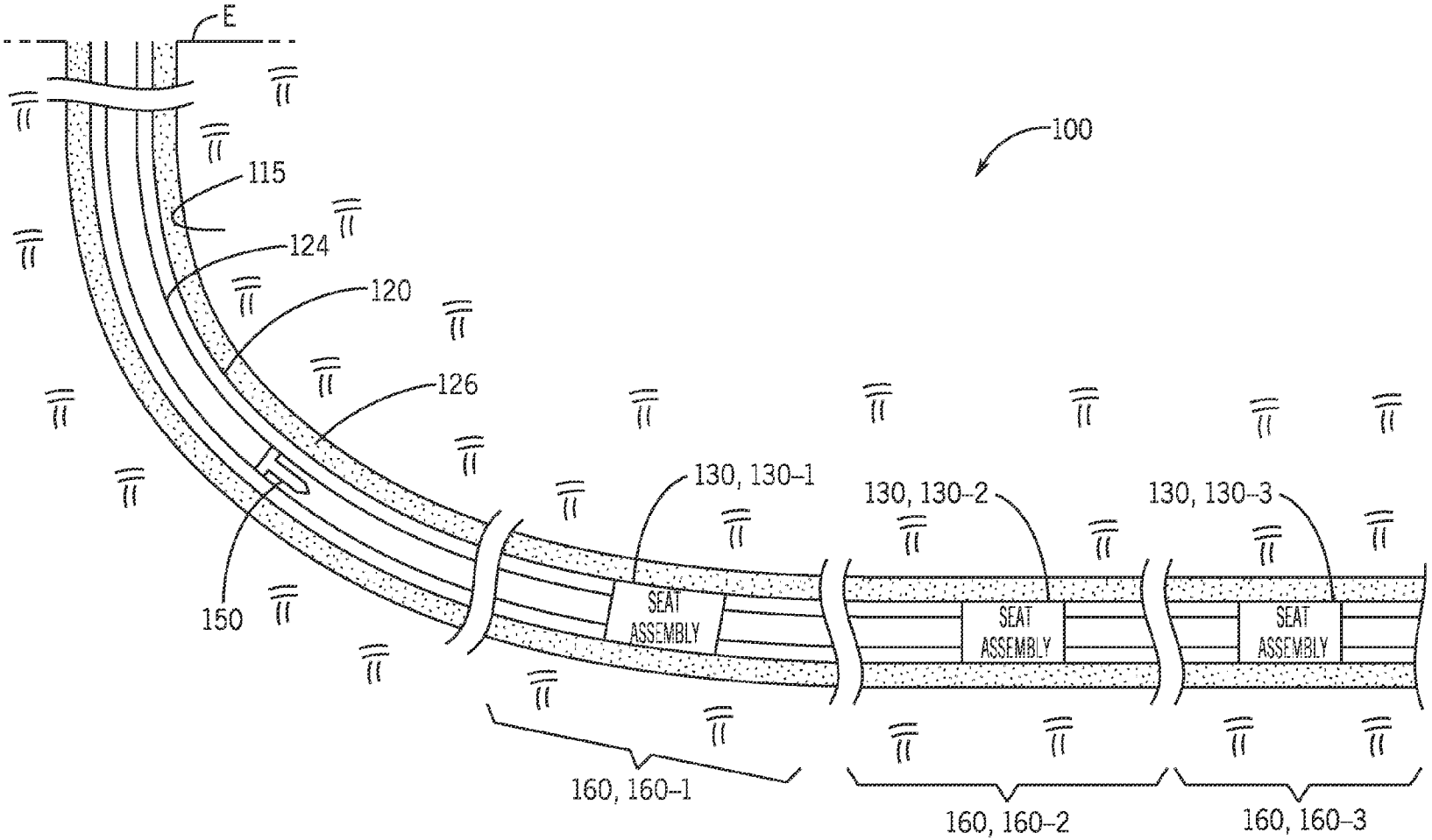
FIG. 1 is a schematic diagram of a well, depicting the use of a dart to perform a downhole operation according to an example implementation.

As a more specific example, FIG. 1 depicts a well 100, which includes a wellbore 115 that traverses one or more formations (hydrocarbon bearing formations, for example). For examples that are disclosed herein, the wellbore 115 is lined, or supported, by a tubing string 120, as depicted in FIG. 1. The tubing string 120 may be cemented to the wellbore 115, as illustrated by cement 126. Such an arrangement may be referred to as a "cased hole" wellbore. However, in accordance with further implementations, the tubing string 120 may be secured to the surrounding formation(s) by packers, in a wellbore often called an "open hole" wellbore. Regardless of whether the wellbore 115 is cased or not, in general, a wellbore 115 extends through one or multiple zones, or stages 160 (three example stages 160-1, 160-2 and 160-3, being depicted in FIG. 1, as examples), of the well 100.

It is noted that although FIG. 1 depicts a lateral wellbore, the systems and techniques that are disclosed herein may likewise be applied to vertical wellbores. Moreover, in accordance with example implementations, the well 100 may contain multiple wellbores, which contain tubing strings that are similar to the illustrated tubing string 120. The well 100 may be a terrestrial or subsea well, and the well 100 may be a production or an injection well depending on the particular implementation. Thus, many variations are contemplated, which are within the scope of the appended claims.

For the following examples, a given downhole operation may be performed from the toe end to the heel end of the wellbore 115, from the heel end to the toe end of the wellbore 115, or, in general, in any particular order. Moreover, although FIG. 1 does not depict perforation tunnels, one or more of the stages 160 may be perforated prior to or after the operations that are disclosed herein or may be performed using a dart 150 (for the case of a single shot-actuated perforating gun, for example). Communication between the wellbore 115 and the surrounding formations may be enhanced by a technique other than perforating, such as a technique that involves the use of a jetting tool that communicates an abrasive slurry, for example.

In general, an operation may be performed in a given stage 160 of the well 100 by communicating the dart 150 downhole through a central passageway 124 of the tubing string 120. The dart 150 has an associated cross-sectional dimension, or diameter, as well as an associated axial dimension, or length. These two characteristic dimensions, in turn, allow the targeting of a particular seat assembly 130 (seat assemblies 130-1, 130-2 and 130-3, being depicted in FIG. 1 as examples) so that the targeted seat assembly 130 catches the dart 150. For example, to target the seat assembly 130-2 of the stage 160-2, a dart 150 having a specific cross-sectional dimension and axial dimension, which correspond to the appropriate dimensions for the seat assembly 130-2, may be communicated from the Earth surface E of the well 100, through the central passageway 124, and eventually be caught by the seat assembly 130-2. Once caught by the seat assembly 130-2, a number of potential downhole operations may be performed. For example, an obstruction formed by the dart 150 inside the seat assembly 130-2 may be used to pressurize a fluid column uphole of the seat assembly 130-2 for purposes of diverting fluid, shifting a valve, and so forth.

As a more specific example, in accordance with some implementations, the seat assembly 130 may be a casing valve assembly, which may be actuated by using a given dart 150. In this manner, the appropriate dart 150 is communicated through the central passageway 124 of the tubing string 120 to select a given seat assembly 130. Once caught, or lodged, in the targeted seat assembly 130, an obstruction is formed. Using this obstruction, the tubing string 120 may be pressurized to shift a sleeve valve of the seat assembly 130 to establish fluid communication between the central passageway 124 of the tubing string 120 and the surrounding formation. Moreover, using this fluid communication, a stimulation operation (a fracturing operation, for example) may be performed in the stage 160.

As further disclosed herein, the darts 150 that may be used with the well 100 may include a set of darts 150 that share a common diameter but have different axial dimensions. These different axial dimensions, in turn, allow the darts 150 of the same diameter to select different seat assemblies 130. Thus, in accordance with example implementations, two characteristic dimensions of the dart 150 allow seat assemblies 130 having the same opening diameter to be selected using darts 150 that have different lengths.

Figure 2A:
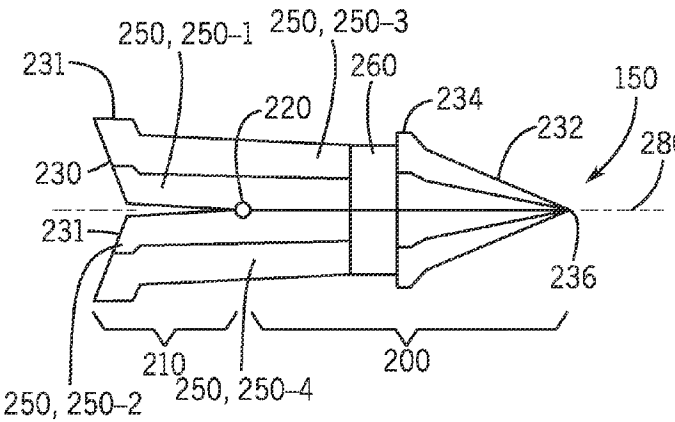
FIG. 2A is a side view of the dart of FIG. 1 in a traveling configuration according to an example implementation.

Referring to FIG. 2A, as a more specific example, the dart 150 may have axially extending segments 250 (segments 250-1, 250-2, 250-3 and 250-4, being shown in FIG. 2A), i.e., segments that each generally extend in a direction along a longitudinal axis of the tubing string 120 and along the dart's longitudinal axis 280. The segments 250 are azimuthally distributed about the dart's longitudinal axis 280 and are pivotably connected at a transverse pivot point connection 220. The pivot point connection 220, in general, longitudinally divides the dart 150 into a front section 200 and a rear section 210. In general, due to the pivot point connection 220, radial expansion of the front section 200 of the dart 150 causes corresponding radial retraction of the rear section 210, and vice versa.

Figure 2B:
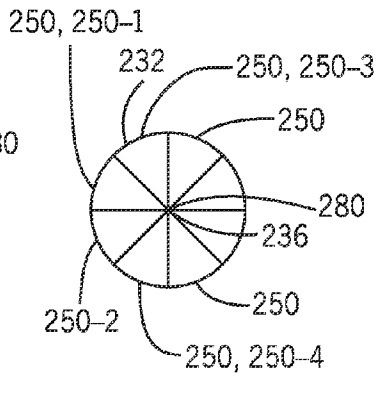
FIG. 2B is a front view of the dart of FIG. 2A according to an example implementation.
Figure 2C:
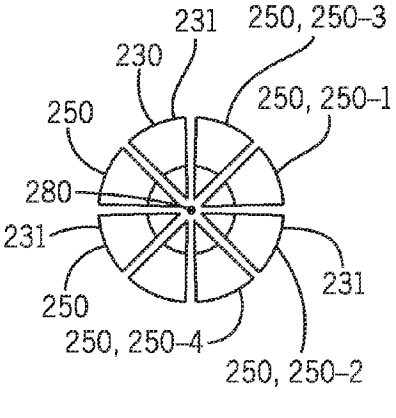
FIG. 2C is a rear view of the dart of FIG. 2A according to an example implementation.

As a more specific example, referring to FIG. 2B in conjunction with FIG. 2A, in accordance with an example implementation, the dart 150 includes eight azimuthally-arranged segments 250, which are pivotably coupled together by the pivot point connection 220 and are biased by a spring 260 (an elastomer band that circumscribes the segments 250 and circumscribes the dart's axis 280, for example) to form a "traveling configuration" for the dart 150. In the traveling configuration, the front section 200 is radially compressed together to cause a front end 236 of the dart 150 to close together to form a point, as depicted in FIG. 2B; and also in the traveling configuration, the rear section 210 of the dart 150 radially expands to expand a rear end 230 of the dart 150, as depicted in FIG. 2C.

In general, in the traveling configuration, fins 231 disposed at the rear end 230 of the dart 150 form the largest cross-sectional dimension for the dart 150; and as such, the fins 231 initially engage seat assemblies 130 that allow the dart 150 to pass therethrough, as well as a targeted seat assembly 130 that catches the dart 150 and thus, does not allow the dart 150 to pass.

Figure 3A:
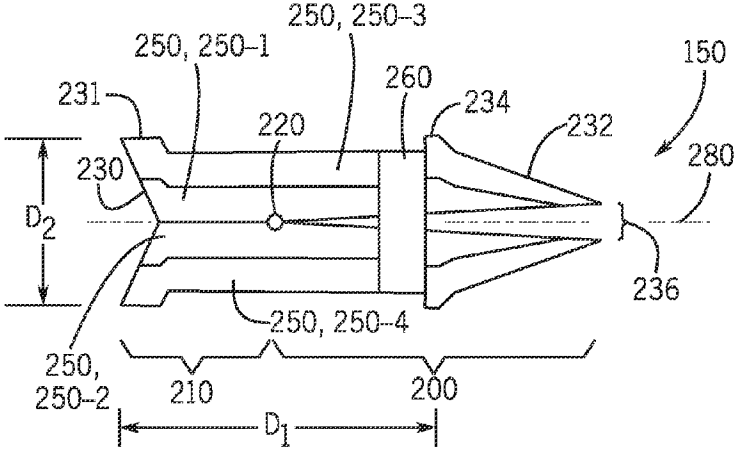
FIG. 3A is a side view of the dart of FIG. 1 in a fully pivoted configuration according to an example implementation.
Figure 3B:
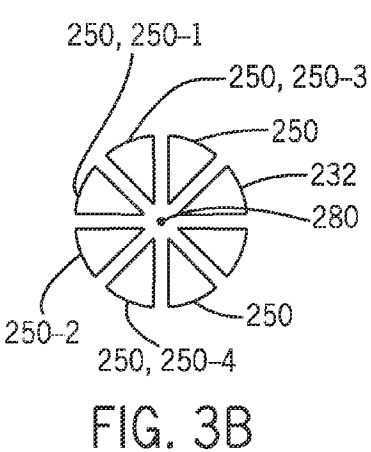
FIG. 3B is a front view of the dart of FIG. 3A according to an example implementation.
Figure 3C:
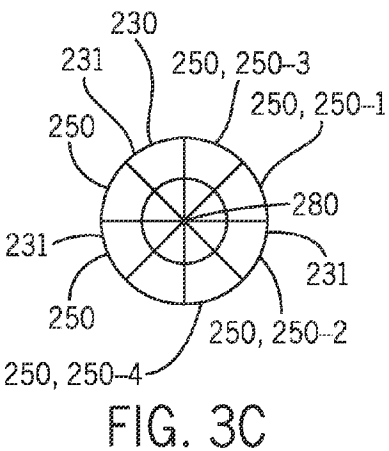
FIG. 3C is a rear view of the dart of FIG. 3A according to an example implementation.

When the fins 231 of the dart engage a given seat assembly 130, the biasing force exerted by the spring 260 is overcome to place the dart 150 in a partially "pivoted configuration" or in a fully "pivoted configuration." The fully pivoted configuration is generally depicted in FIG. 3A. In this configuration, the rear section 210 is radially compressed to cause the rear end 230 of the dart 150 to close together, as depicted in FIG. 3C; and also in the pivoted configuration, the front section 200 of the dart 150 radially expands to radially expand the front end 236, as depicted in FIG. 3B, so that front fins 234 form the largest cross-sectional dimension for the dart 150.

As further described herein, as a result of the engagement of the dart 150 with a given seat assembly 130, the dart 150 pivots about the pivot point connection 220 to at least attempt (as permitted by the controlling characteristic dimensions of the seat assembly 130, as described below) to transition to the fully pivoted configuration, which is depicted in FIG. 3A. The extent to which the tail end 230 compresses, in turn, controls whether the dart 150 is caught, or retained, by a given seat assembly 130 or passes through the seat assembly 130.

More specifically, as depicted in FIG. 3A, the dart 150 has a characteristic axial dimension, or length (called "$D_1$" in FIG. 3A) and a characteristic cross-sectional dimension, or diameter (called "$D_2$" in FIG. 3A). As further described herein, the characteristic dimensions $D_1$ and $D_2$ are determinative of whether the dart 150 is caught by a given seat assembly 130.

Figure 4A:
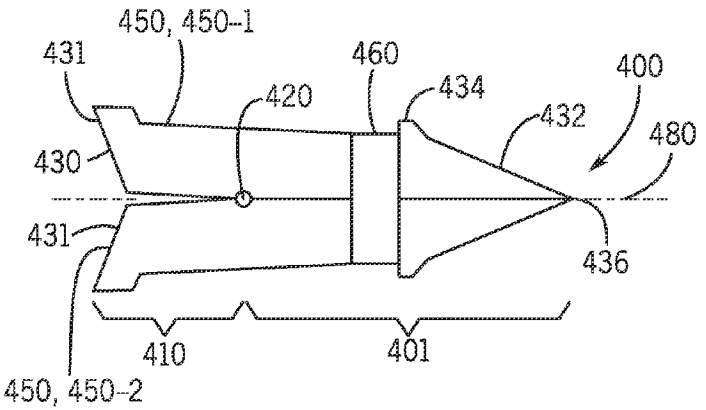
FIG. 4A is a side view of a dart in a traveling configuration according to a further example implementation.
Figure 4B:
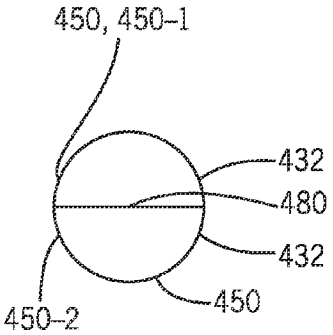
FIG. 4B is a front view of the dart of FIG. 4A according to an example implementation.
Figure 4C:
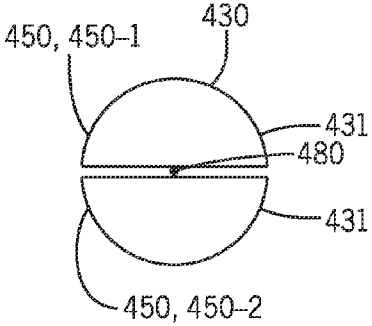
FIG. 4C is a rear view of the dart of FIG. 4A according to an example implementation.

It is noted that the dart 150 may have less than or more than eight azimuthally-arranged segments 250, depending on the particular implementation. For example, FIG. 4A depicts a dart 400 that has the same general design as the dart 150, except that the dart 400 is formed from two azimuthally-arranged axial segments 450 (i.e., segments 450-1 and 450-2). In this regard, segments 450 are pivotably connected together at a pivot connection 420 to form a front section 401, a rear section 410 and corresponding front 436 and rear ends 430. Moreover, the dart 400 includes a spring 460 that biases the dart 400 to be in the traveling configuration, similar to the biasing described above for the dart 150. FIGS. 4B and 4C depict the front and rear views, respectively, of the dart 400 in the traveling configuration.

Figure 5A:
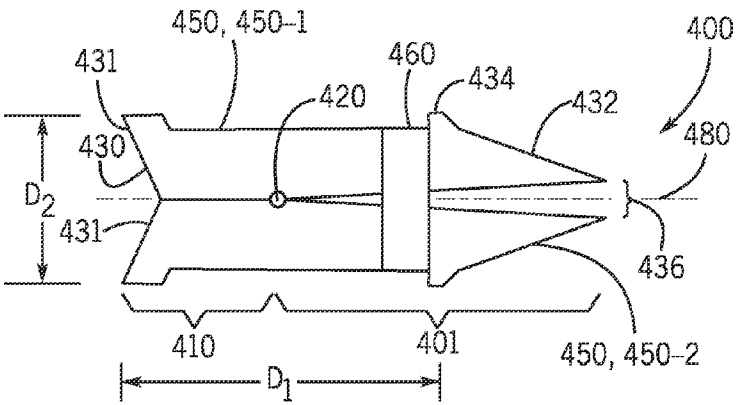
FIG. 5A is a side view of a dart in a fully pivoted configuration according to a further example implementation.
Figure 5B:
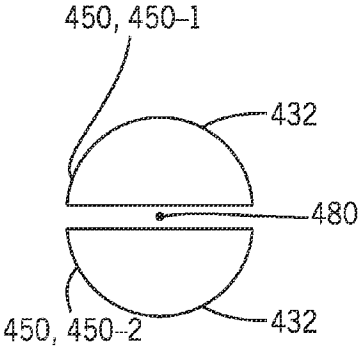
FIG. 5B is a front view of the dart of FIG. 5A according to an example implementation.
Figure 5C:
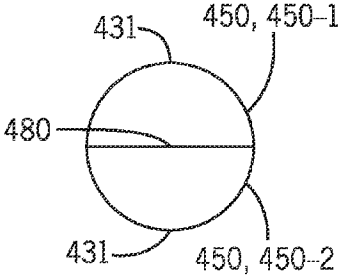
FIG. 5C is a rear view of the dart of FIG. 5A according to an example implementation.

FIG. 5A depicts the dart 400 in a fully pivoted configuration, similar to the fully pivoted configuration that is described above for the dart 150 (see FIG. 3A). As shown, in this pivoted configuration, the dart 400 has a radially expanded front end 436 (with front fins 434 in a radially expanded position) and a radially compressed the rear end 430. The corresponding front and rear views of the dart 400 when in the pivoted configuration are depicted in FIGS. 5B and 5C, respectively.

Although for purpose of the following examples, references are made to the dart 400, the dart 150 may also be used, as well as darts that have other designs and are constructed from a number of axial segments other than two or eight.

Figure 6:
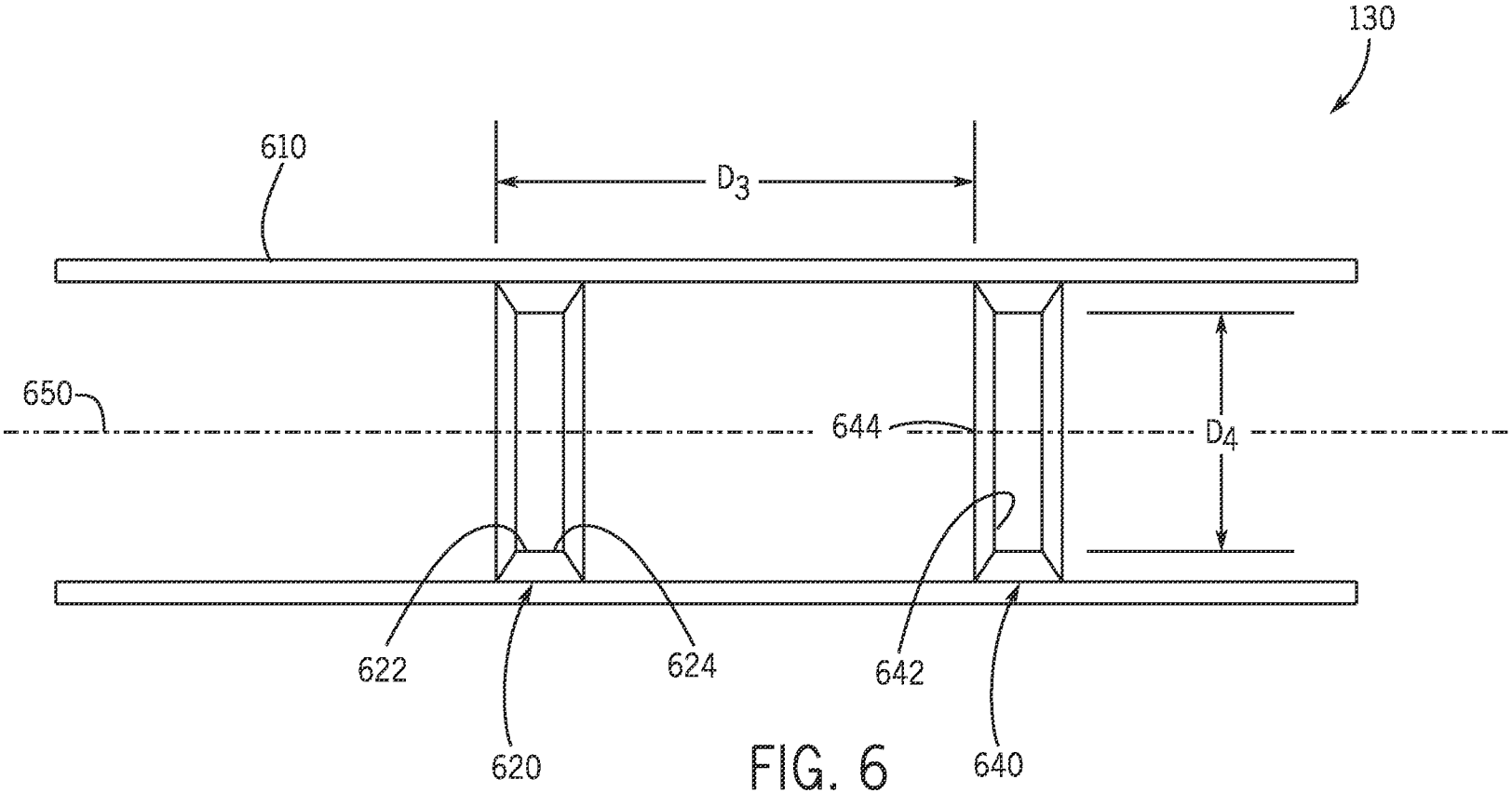
FIG. 6 is a cross-sectional view of the seat assembly of FIG. 1 according to an example implementation.

Referring to FIG. 6, in accordance with an example implementation, the seat assembly 130 has a tubular body 610 that is concentric with a longitudinal axis 650 of the assembly 130 (and concentric with the tubing string 120 (see FIG. 1)). For this example, the seat assembly 130 includes an upper seat 620 and a lower seat 640. The upper 620 and lower 640 seats are separated by an axial length (called "$D_3$" in FIG. 6). Moreover, the upper 620 and lower 640 seats for this example have a common characteristic diameter (called the "$D_4$ dimension" in FIG. 6) shared in common. As further described below, the $D_1$ and $D_2$ dimensions of the dart 400 are selected based on the $D_3$ and $D_4$ dimensions of the seat assembly 130 that is targeted by the dart 400.

Moreover, as disclosed herein, the upper seat 620 has a central opening 622 that is concentric with the axis 650 and includes an inner cylindrical surface 622 (a polished seal bore, as an example) for purposes of forming a fluid seal with a sealing surface of the dart 400 when the dart 400 is caught by the seat assembly 130; and the lower seat 640 has a central opening 544 that is concentric with the axis 650 and includes an inclined, or beveled, surface 644 for purposes of anchoring the dart to the seat assembly 130.

Figure 7A:
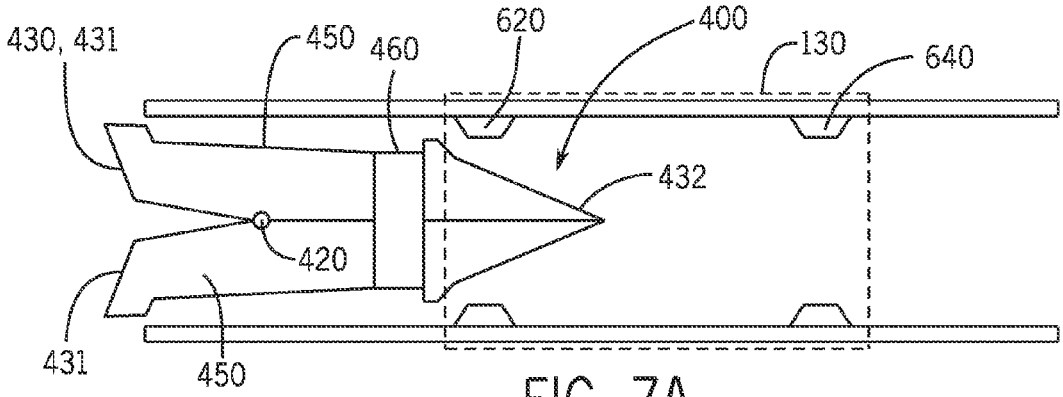
FIG. 7A is a schematic view illustrating initial entry of the dart into a seat assembly configured to catch the dart according to an example implementation.

FIGS. 7A, 7B, 7C and 7D depict travel of the dart 400 into a seat assembly 130, where the $D_1$ and $D_2$ dimensions of the dart 400 are selected so that the seat assembly 130 catches the dart 400. More specifically, FIG. 7A depicts entry of the dart 400 into the seat assembly 130, such that the front end 432 of the dart 400 enters the upper seat 620. As depicted in FIG. 7A, the diameter (i.e., the $D_2$ dimension of FIG. 5A) of the dart 400 is sized such that when fully radially compressed, the dart 400 may pass through the seats 620 and 640. In the traveling configuration, the front end 432 is fully radially compressed, thereby, for this example, allowing the front end 432 to pass through the upper seat 620.

Figure 7B:
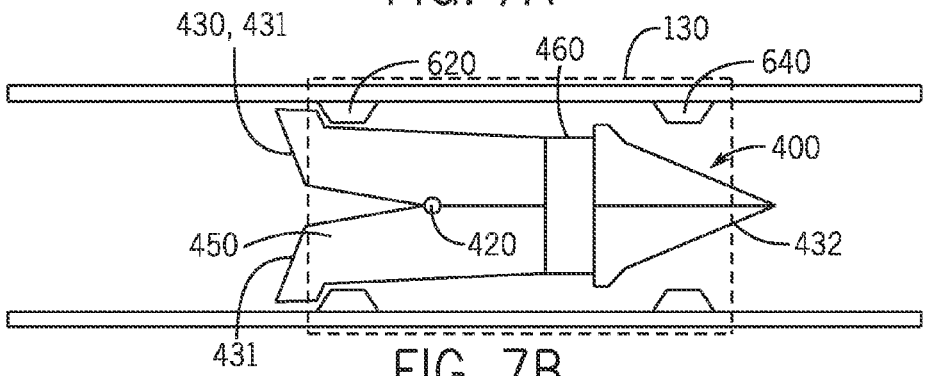
FIG. 7B is a schematic view illustrating initial engagement of a rear end of the dart with an upper seat of the seat assembly of FIG. 7A according to an example implementation.
Figure 7C:
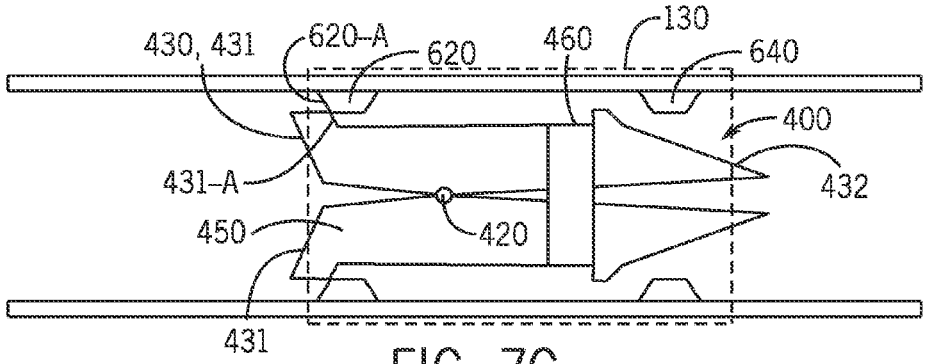
FIG. 7C is a schematic view illustrating the rear end of a dart being radially compressed by the upper seat of the seat assembly of FIG. 7A according to an example implementation.
Figure 7D:
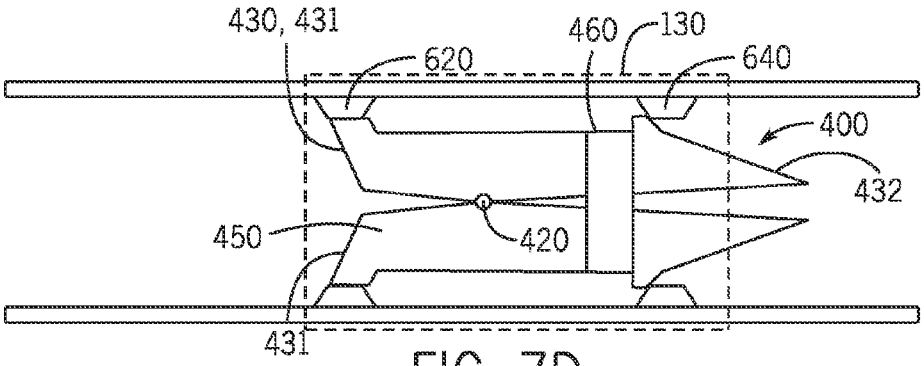
FIG. 7D is a schematic view illustrating a lower seat of the seat assembly of FIG. 7A restricting the radial compression of the rear end of the dart to cause the dart to be caught by the seat assembly according to an example implementation.

As depicted in FIG. 7B, in the traveling configuration, the fins 431 at the rear end 430 of the dart 400 initially engages the seat assembly 130 by entering the opening that is defined by the upper seat 620. Due to the entry of the dart 400 into this opening, the rear end 430 of the dart 400 partially radially compresses, as depicted in FIG. 7C. For this example, however, the rear end 430 does not fully radially compress (and thus, does not transition to the fully pivoted configuration), as the radial compression of the rear end 430 is limited by the restriction that is imposed by the lower seat 640. In this manner, as depicted in FIG. 7D, the front end 432 of the dart 400 radially expands in response to the radial compression of the rear end 430. The front end 432 does not, however, fully radially expand, thereby limiting the radial compression of the rear end 430. As a result, the rear end 430 does not compress sufficiently to allow the dart 430 to pass through the upper seat 620. Moreover, the dart 400 is further retained by the front end 432 radially expanding against the lower seat 640. Thus, the dart 400 is retained, or "caught," by the seat assembly 130.

FIGS. 8A, 8B, 8C and 8D depict travel of the dart 400 into a seat assembly 130 that has dimensions that allow a dart 400 having the relative characteristic dimensions depicted in these figures to pass through the seat assembly 130. In this regard, comparing FIGS. 8A, 8B, 8C and 8D to FIGS. 7A, 7B, 7C and 7D, the seats 620 and 640 of both seat assemblies 130 for these examples have the same cross-sectional dimensions. However, for FIGS. 8A, 8B, 8C and 8D, the upper 620 and lower 640 seats are spaced apart by a greater axial distance.

Figure 8A:
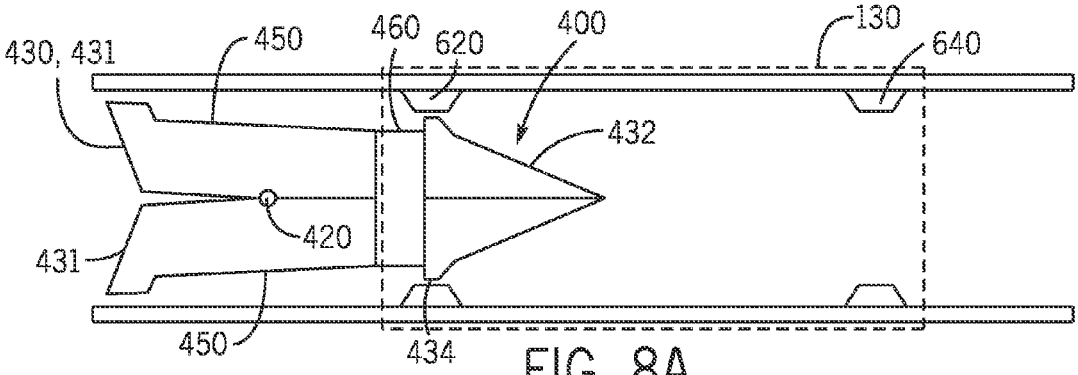
FIG. 8A is a schematic view illustrating initial entry of the dart into a seat assembly configured to allow the dart to pass through the assembly according to an example implementation.
Figure 8B:
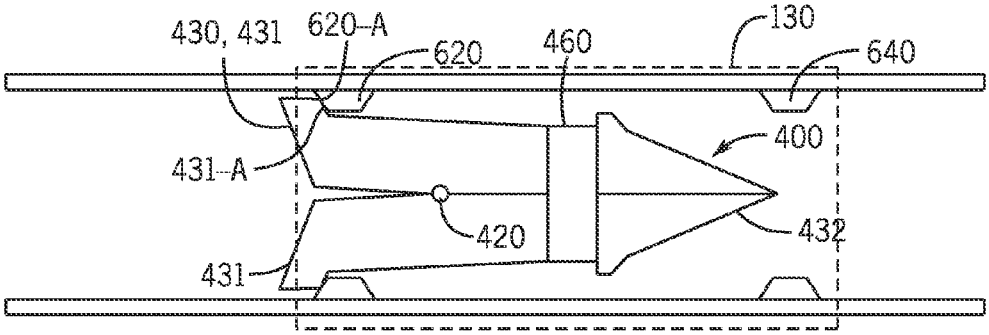
FIG. 8B is a schematic view illustrating initial engagement of a rear end of the dart with an upper seat of the seat assembly of FIG. 8A according to an example implementation.
Figure 8C:
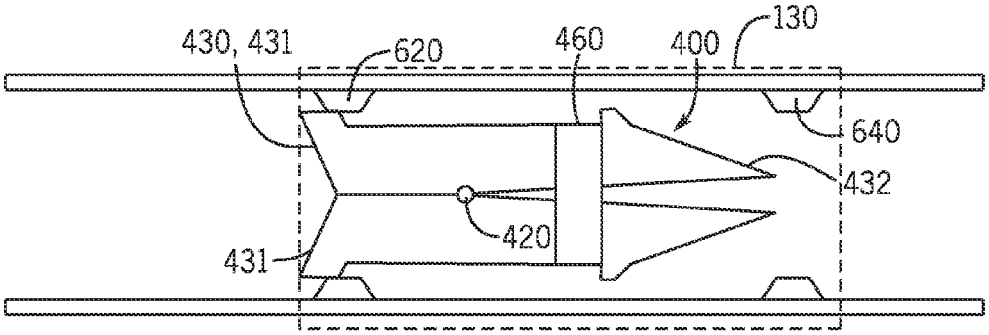
FIG. 8C is a schematic view of the dart illustrating the rear end of the dart being radially compressed by the upper seat of the seat assembly of FIG. 8A according to an example implementation.
Figure 8D:
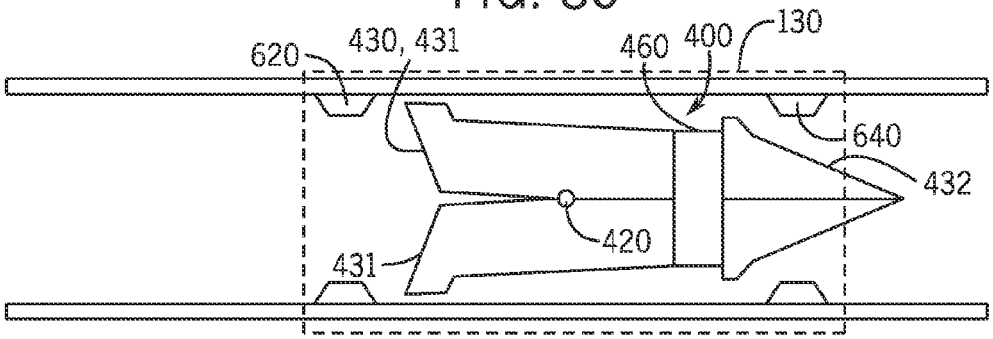
FIG. 8D is a schematic view illustrating the dart passing through the upper seat of the seat assembly according to an example implementation.

Referring to FIG. 8A, the dart 400 enters the upper seat 620 such that the front end 432 passes through the upper seat 620 because the dart 400 is in the traveling configuration. Referring to FIG. 8B, upon encountering the upper seat 620, the fins 431 of the rear end 430 of the dart 400 engage the upper seat 620 to compress the dart 400, as depicted in FIG. 8C. Thus, as shown in FIG. 8C, the front end 432 radially expands, while the rear end 430 radially compresses. For this example, the seats 620 and 640 are spaced apart sufficiently such that the radial expansion of the front end 432 is not limited by the lower seat 640. Therefore, the rear end 430 is allowed to sufficiently radially compress to place the dart 400 in the fully pivoted configuration and allow the rear end 430 to pass through the upper seat 620, as depicted in FIG. 8D. Although not depicted in figures, the dart 400 passes through the lower seat 640 of the seat assembly 130 in a similar manner.

Figure 9A:
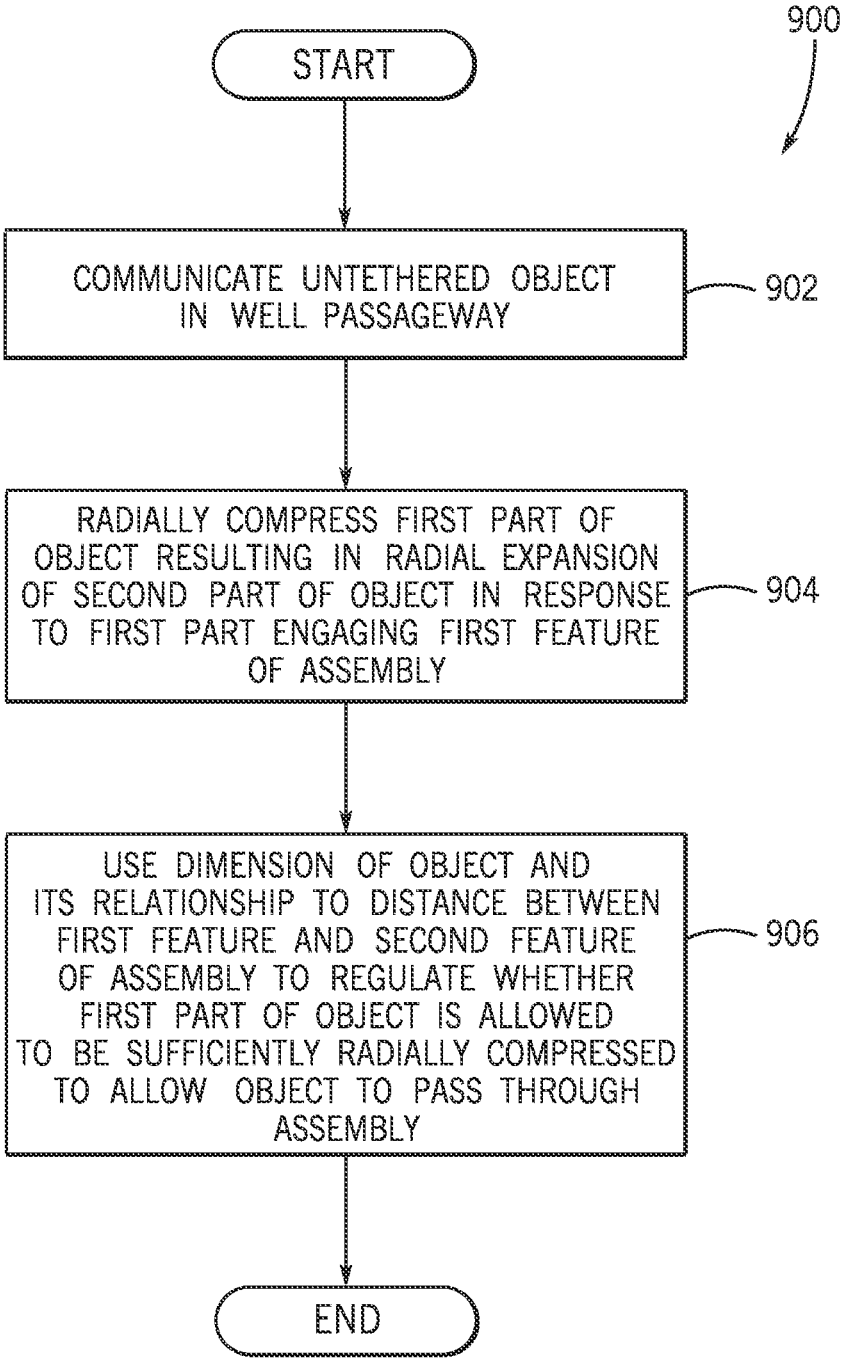
FIGS. 9A and 9B are flow diagrams depicting techniques to selectively catch a dart in a seat assembly according to example implementations.

Thus, referring to FIG. 9A, in accordance with example implementations, a technique 900 includes communicating (block 902) an untethered object in a well passageway and radially compressing (block 904) a first part of the object, which results in the radial expansion of a second part of the object in response to the first part engaging a first feature of the assembly. The technique 900 includes using a dimension of the object and its relationship to distance between the first feature and a second feature of the assembly to regulate whether the first part of the object is allowed to be sufficiently radially compressed to allow the object to pass through the assembly, pursuant to block 906.

Figure 9B:
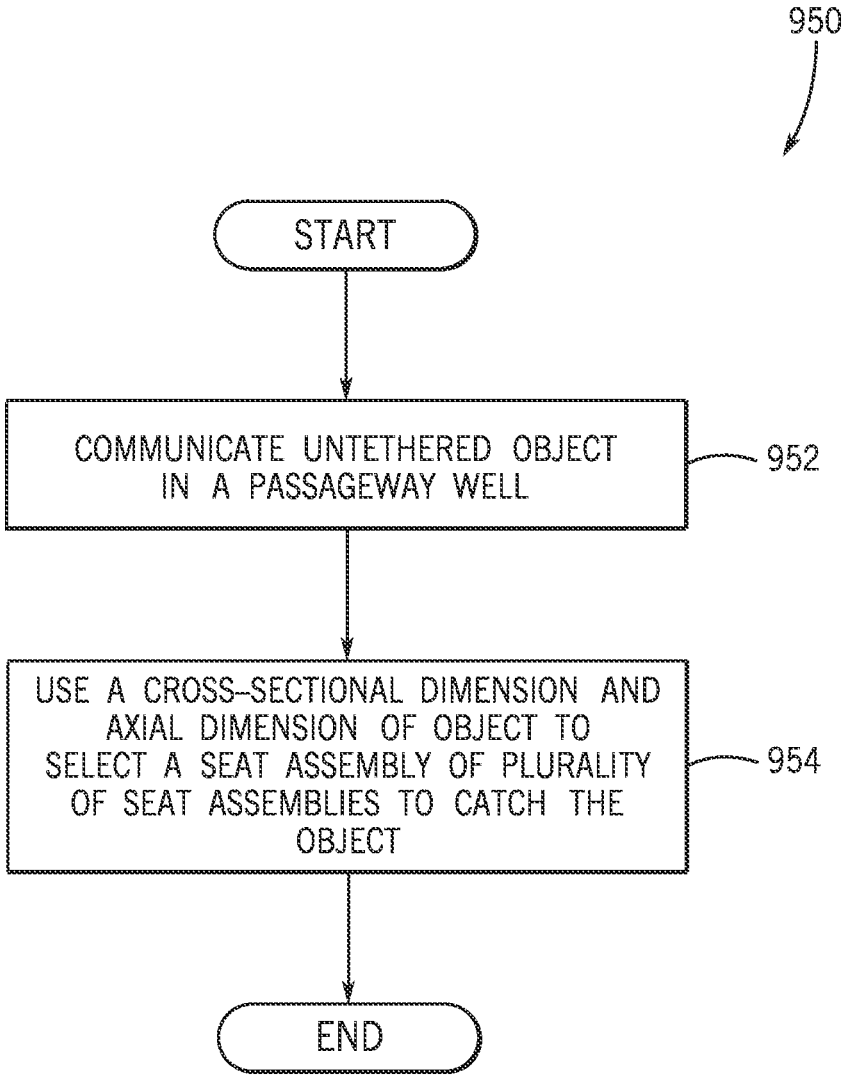

Referring to FIG. 9B, in accordance with example implementations, a technique 950 includes communicating an untethered object into a passageway that extends into a well, pursuant to block 952. Pursuant to the technique 950, the cross-sectional dimension and an axial dimension of the object is used (block 954) to select a seat assembly of a plurality of seat assemblies to catch the object to perform a given operation in the well.

Figure 10:
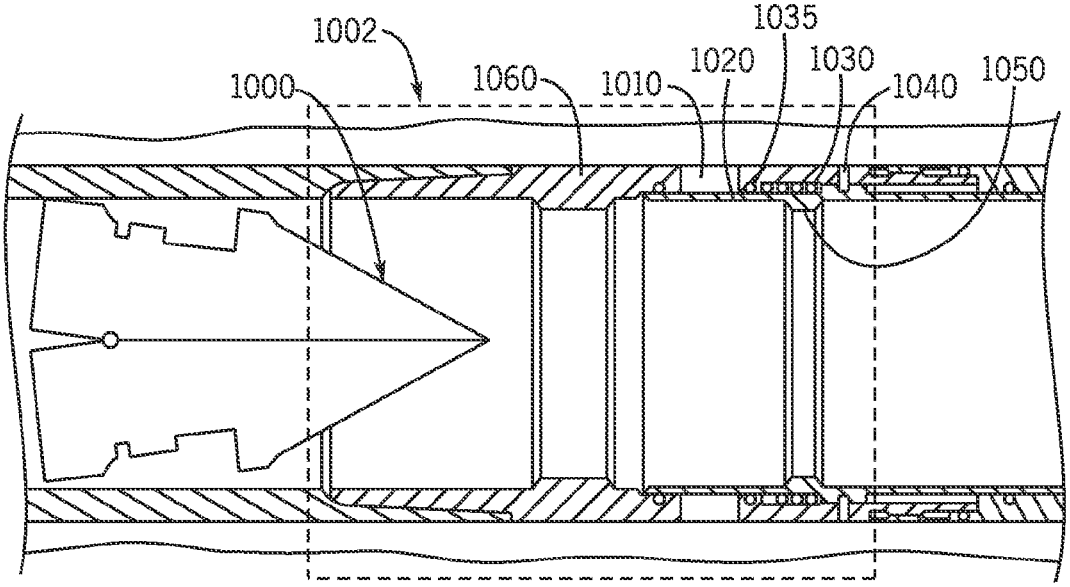
FIG. 10 is a schematic view illustrating a dart in a traveling configuration entering a casing valve assembly configured to catch the dart and be actuated using the dart according to an example implementation.

FIG. 10 depicts a dart 1000 entering a casing valve assembly 1002 that is constructed to capture the dart 1000 so that the dart 1000 may be used to shift a sliding sleeve 1020 of the assembly 1002 and then release the dart 1000 so that the dart 1000 may travel further downhole to possibly engage one or more other casing valve assemblies, in accordance with an example implementation. More specifically, the sliding sleeve 1020 has the position shown in FIG. 10 when the casing valve assembly 1002 is run into the well, which seals off fluid communication through radially-directed fracture ports 1010. In this manner, when initially installed as part of a tubing (such as the tubing string 120 of FIG. 1, for example), the casing valve assembly 1002 may be closed, i.e., the sliding sleeve 1020 may cover the fracture ports 1010 to isolate the surrounding formation from the central passageway of the valve assembly 1002. The dart 1000 may thus, be deployed into the string, have characteristic dimensions to target the casing valve assembly 1002 and be used to operate the assembly 1002 to shift the sliding sleeve 1020 to a position at which the sleeve 1020 no longer covers the fracture ports 1010 to open communication through the ports 1010.

Figure 11A:
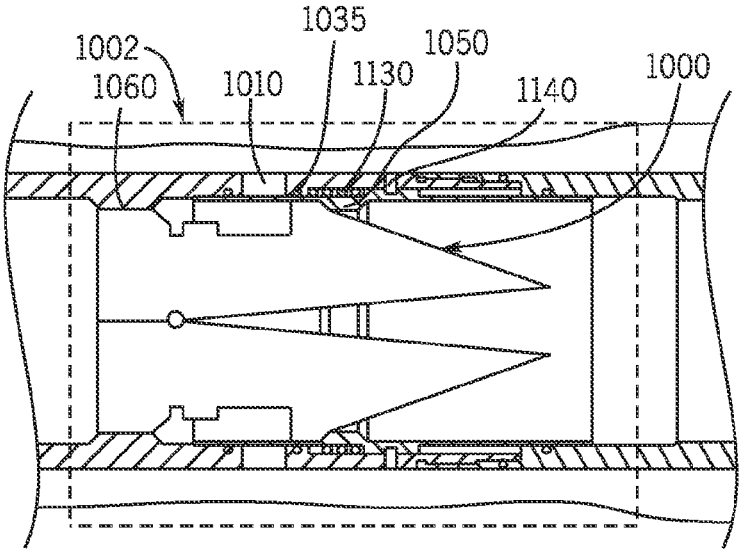
FIG. 11A is a schematic view of a portion of the casing valve assembly of FIG. 10 illustrating the capturing of the dart by the assembly before the dart is used to shift a sleeve of the assembly according to an example implementation.

More specifically, FIG. 10 depicts the initial entry of the dart 1000 into the casing valve assembly 1002. As depicted in FIG. 11A, the casing valve assembly 1002 captures the dart 1000, due to the initial axial distance between a lower seat 1050 of the assembly 1002, which is part of the sleeve 1020 and an upper seat 1060 of the assembly 1002, which is secured to the assembly's housing. In this configuration, the lower seat 1050 is positioned to inhibit full radial expansion of the dart's front end Moreover, in this configuration, a peripheral surface of the dart 1000 forms a fluid seal with the corresponding surface of the upper seat 1060, and the front end of the dart 1000 contacts the corresponding surface of the lower seat 1050. Upon application of sufficient fluid to the fluid column above the dart 1000 (by pumping fluid into a string, for example), an axial force is applied to shift, or translate, the sliding sleeve 1020 to uncover the fracture ports 1010, thereby opening lateral fluid communication through the casing valve assembly 1002.

Figure 11B:
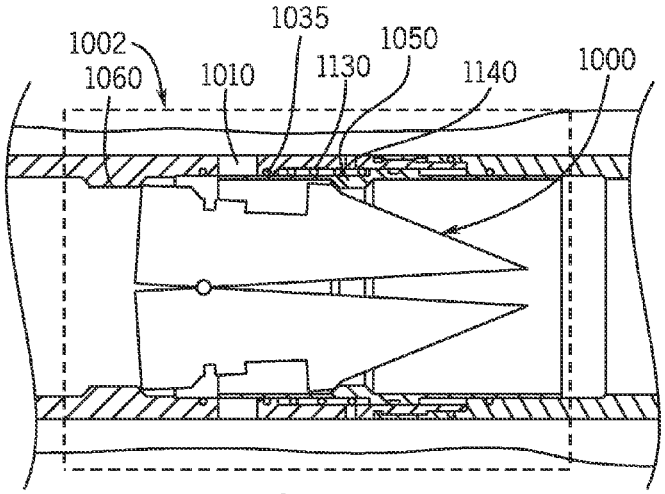
FIG. 11B is a schematic view of a portion of the casing valve assembly of FIG. 10 illustrating an intermediate shifted position of the sleeve of the assembly according to an example implementation.

FIG. 11B depicts an intermediate position of the sliding sleeve 1020, as the dart 1000 shifts the sleeve 1020. As shown, the front end of the dart 1000 is between its fully open and fully closed positions. As depicted in FIGS. 10, 11A and 11B, the sliding sleeve 1020 may be biased to be closed by a coiled spring 1030 (or gas spring), as well as may be initially secured in place by shear screws 1040. Upon application of sufficient pressure, the shear screws 1040 shear, and the force exerted by the spring 1030 is overcome for purposes of opening the casing valve assembly 1002.

Figure 11C:
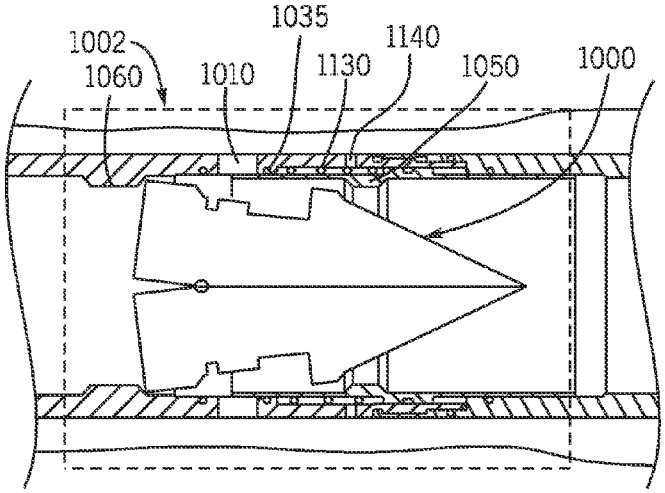
FIG. 11C is a schematic view of a portion of the casing valve assembly of FIG. 10 illustrating a final shifted position of the sleeve allowing release of the dart according to an example implementation.

FIG. 11C depicts the casing valve assembly 1002 in its fully open state in which the sliding sleeve 1020 has been completely shifted by the dart 1000. As shown, due to the increased axial spacing between the upper 1050 and lower 1060 seats, the casing valve assembly 1002 is no longer configured to retain the dart 1000. As such, the dart 1000 may pass on through the casing valve assembly 1002 and travel further downhole to target one or more valve assemblies to perform similar valve actuations. Thus, in accordance with example implementations, a single dart 1000 and multiple casing valve assemblies 1002 may be used to open multiple fracture points within a single target zone.

Figure 12:
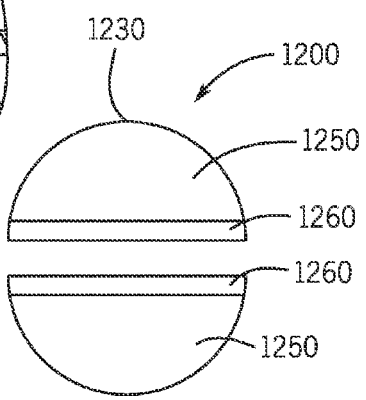
FIG. 12 is a rear view of a dart according to an example implementation.

Referring to FIG. 12, in accordance with example implementations, a dart 1200 may have a rear end 1230 (depicted in a rear view of the dart) that is formed from pivoting axially-arranged longitudinal members 1250, which contain corresponding sealing elements 1260 for purposes of forming a fluid seal when the rear end 1230 of the dart 1200 is fully radially compressed. This allows the fluid column above the dart 1200 to be pressurized for purposes of shifting a valve, such as the example described above for the casing valve assembly 1002.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. An apparatus usable with a well, comprising:
a pivot connection;
a plurality of members coupled together with a biasing member, wherein each of the plurality of members comprises a first section and a second section separated by an axially extending segment, wherein the pivot connection is positioned between the plurality of members first section and second section along the axially extending segments, the plurality of members being adapted to:
be communicated untethered into the well;
in response to engaging a seat assembly in the well, pivot about the pivot connection to radially expand the first section and radially compress the second section; and
select whether the seat assembly catches the plurality of members.

2. The apparatus of claim 1, wherein the first and second sections comprise portions having a cross-sectional dimension greater than the axially extending section.

3. The apparatus of claim 2, wherein the plurality of members are adapted to selectively engage a first feature of the seat assembly to cause the radial expansion and radial contraction based on a cross-sectional dimension of the first feature, and the seat assembly comprises a second feature adapted to control whether the radial contraction is sufficient to allow the second section to pass through the first feature.

4. The apparatus of claim 3, wherein the plurality of members are further adapted to selectively engage the second feature based on an axial distance between the first and second features.

5. The apparatus of claim 2, wherein the plurality of members are adapted to extend axially along a passageway of a string during communication of the plurality of members into the well, the first section forms a head of a dart, and the second section forms a tail of the dart.

6. The apparatus of claim 2, wherein the plurality of members are adapted to form a fluid seal between the second section and the well seat assembly in response to the seat assembly catching the plurality of members.

7. The apparatus of claim 2, wherein the plurality of members are adapted to be caught by the seat assembly to form an obstruction and shift a valve of the seat assembly in response to a pressurization due to the obstruction.

8. A method usable with a well, comprising:
communicating an untethered object in a passageway downhole in the well, the untethered object having a plurality of members coupled together with a biasing member and a pivot connection between the plurality of members, the plurality of members each comprising a first section and a second section separated by an axially extending segment;
pivoting about the pivot connection to radially expand the first section and radially compress the second section in response to engaging a seat assembly in the well; and
using a cross-sectional dimension of the object and an axial dimension of the object to select a seat assembly of a plurality of seat assemblies to catch the object to form an obstruction in the well.

9. The method of claim 8, wherein:
the plurality of seat assemblies comprises a first seat assembly having a cross-sectional dimension sized to at least temporarily catch the object and a second seat assembly having a cross-sectional dimension sized to at least temporarily catch the object; and
using the cross-sectional dimension of the object and the axial dimension of the object comprises:
capturing the object in the first seat assembly;
causing the first seat assembly to release the captured object in response to the axial dimension of the object;
capturing the object in the second seat assembly;
causing the second seat assembly to retain the captured object in response to the axial dimension of the object.

10. The method of claim 8, wherein:
capturing the object in the first seat assembly comprises capturing the object in a first seat of the first seat assembly; and
causing the first seat assembly to release the captured object comprises radially contracting the object.

11. The method of claim 9, wherein:
capturing the object in the second seat assembly comprises capturing the object in a first seat of the second seat assembly; and
causing the second seat assembly to retain the captured object comprises:
radially contracting a first part the object in contact with the first seat by pivoting at least one member of the object about a pivot point, the pivoting causing a second part of the object to radially expand; and
using a second seat of the second seat assembly to engage the second part to limit an extent of the radial contraction.

12. The method of claim 8, wherein communicating untethered object comprises communicating a dart into the well.

* * * * *